United States Patent [19]

Fasolak

[11] 4,265,411

[45] May 5, 1981

[54] PAPER ROLL BACKSTAND

[76] Inventor: Ambrozy J. Fasolak, 124 W. Venango St., Philadelphia, Pa. 19140

[21] Appl. No.: 58,500

[22] Filed: Jul. 18, 1979

[51] Int. Cl.[3] ..... B65H 19/12

[52] U.S. Cl. ..... 242/58.6; 242/68.4

[58] Field of Search ..... 242/58.6, 79, 68.4, 242/78.6

[56] References Cited

U.S. PATENT DOCUMENTS

| | | | |
|---|---|---|---|
| 2,323,104 | 6/1943 | Washam | 242/78.6 |
| 2,391,265 | 12/1945 | Palmer | 242/68.4 |
| 2,490,685 | 12/1949 | Greene | 242/79 X |
| 2,635,823 | 4/1953 | Weber et al. | 242/58.6 |
| 2,920,839 | 1/1960 | Sarka | 242/68.4 X |
| 3,057,571 | 10/1962 | Aaron et al. | 242/58.6 |
| 3,343,760 | 9/1967 | Haskin et al. | 242/58.6 |
| 3,584,808 | 6/1971 | Staples | 242/68.4 |

*Primary Examiner*—John M. Jillions

*Attorney, Agent, or Firm*—Harding, Earley & Follmer

[57] ABSTRACT

A backstand for unwinding a roll of paper comprising a pair of chocks adapted to enter opposite ends of a core of a roll of paper and rotatably support the paper roll, a housing supporting each chock, a worm connected to each housing for moving the chocks toward and away from each other, a worm nut meshing with the worm and supported in an upright position beneath the housing, and a guard mounted over each worm to protect the worm from damage from objects which are dropped, such as rolls of paper.

3 Claims, 3 Drawing Figures

PAPER ROLL BACKSTAND

BACKGROUND OF THE INVENTION

In conventional backstands for unwinding rolls of paper, which use a worm mechanism for moving the housings and chucks toward and away from each other, the chucks being moved away from each other in order to accept a roll of paper and being moved toward each other in order to rotatably hold that roll of paper, the worm nut is suspended downwardly from the housing and connected to the worm. Such worms are exposed and may be damaged by objects which are dropped and strike the worm. A guard cannot be placed on top of the worm because the guard would interfere with the movement of the worm nut and housing as they are moved back and forth by the rotation of the worm.

SUMMARY OF THE INVENTION

The present invention solves the problem of protecting the worm against damage by falling objects by providing a housing having two legs with an opening therebetween, by mounting the worm nut upright on a plate that spans the two legs of the housing, and by mounting a guard plate over the worm in the space between the worm nut and the housing.

DETAILED DESCRIPTION OF THE INVENTION

Figure 1:
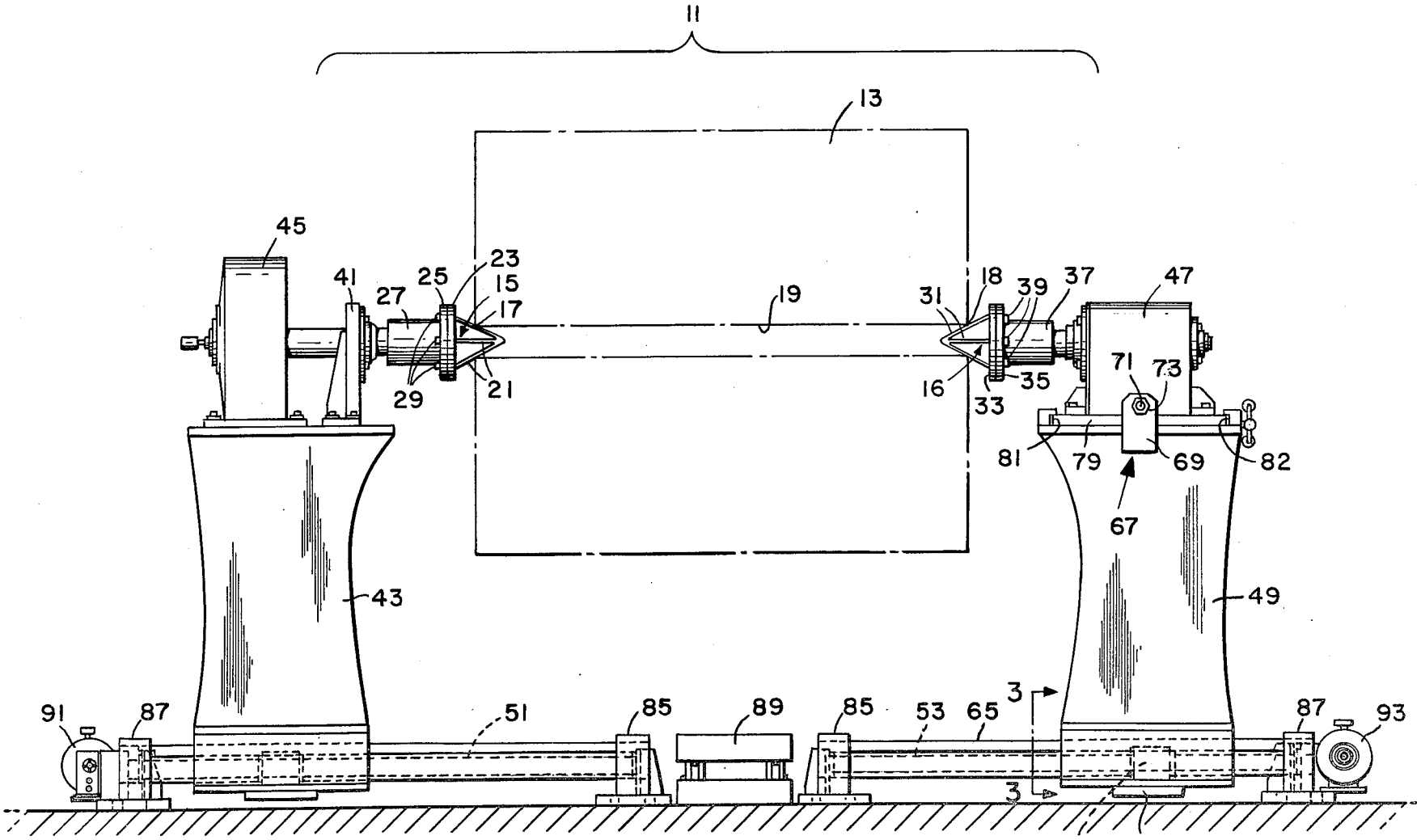
FIG. 1 is a view in side elevation of a paper roll backstand constructed in accordance with this invention.
Figure 2:
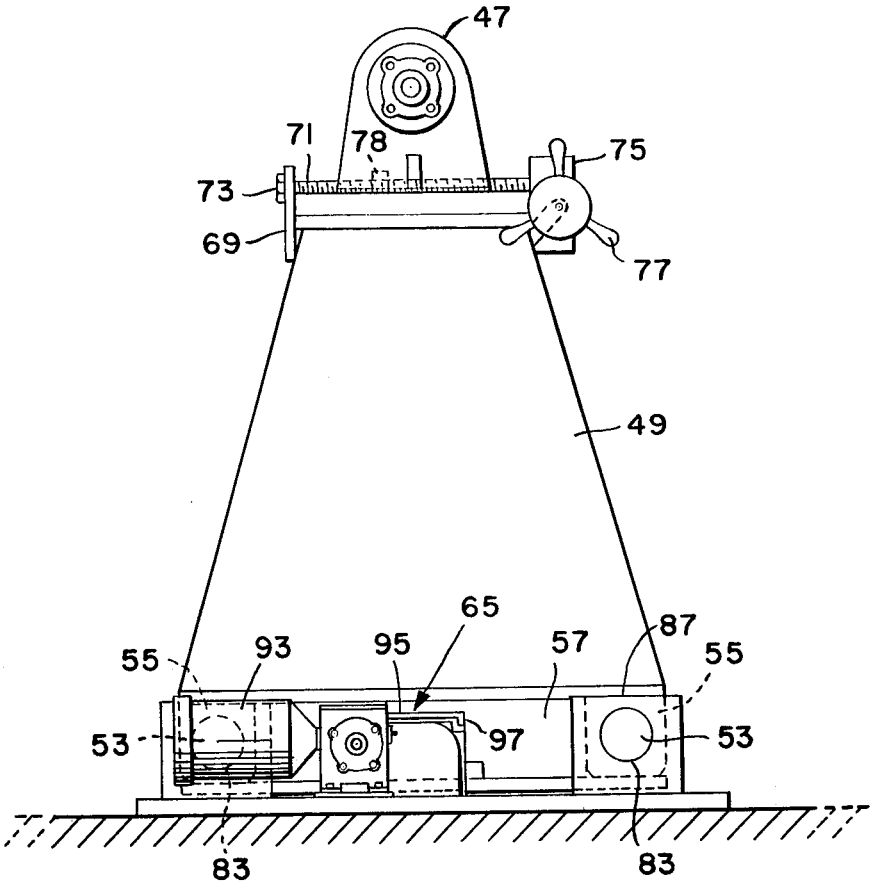
FIG. 2 is a view in front elevation of the paper roll backstand shown in FIG. 1.
Figure 3:
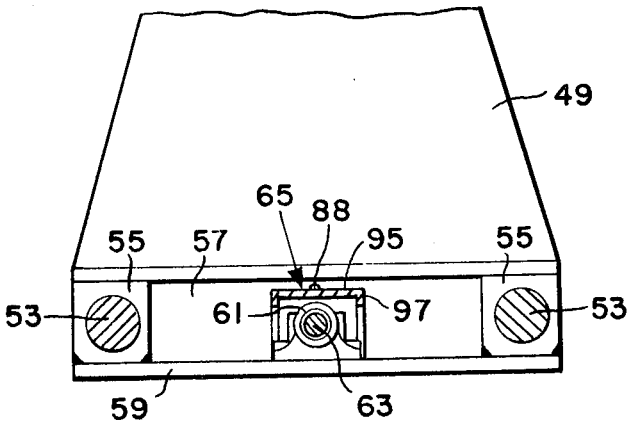
FIG. 3 is a view in section taken as indicated by the lines and arrows 3—3 that appear in FIG. 1.

Turning now to the drawings, there is shown a paper roll backstand 11 for unwinding all or a part of a roll 13 of paper, which comprises a pair of chucks 15, 16 that face each other and are adapted to enter opposite ends 17, 18 of a core 19 of the paper roll 13.

Chuck 15 is welded together and includes tapered fins 21 connected at their base to a flange 23 that is bolted to a flange 25 of a rotatable chuck shaft 27. The flanges 23, 25 and bolts 29 permit easy removal of chuck 15 from shaft 27 and replacement of the chuck.

Chuck 16 includes tapered fins 31 mounted on a base flange 33 that is removably connected to a flange 35 mounted on a rotatable chuck shaft 37 by bolts 39.

Chuck 15 is mounted on a chuck support assembly 41 on a housing 43. Chuck shaft 27 is provided with a brake mechanism 45 for slowing down the rotational speed of the shaft 27 and thereby the chucks 15, 16 to slow the unwinding speed of paper from roll 13 held by the chucks.

Chuck 16 is mounted on a chuck support assembly 47 on a housing 49.

Housings 43 and 49 are slideably supported for movement in unison toward and away from each other, with housing 43 being slideably supported on a pair of spaced apart rails 51, and housing 49 being slideably supported on a pair of spaced apart rails 53.

Each housing 43, 49 has a pair of depending legs 55 with a space 57 between them.

A support plate 59 is mounted on the bottom of each housing and connected between the legs 55, and a worm nut 61 is mounted on the top surface of support plate 59 so that the worm nut 61 is in an upright position and in mesh with the worm 63.

A guard 65 is mounted over each worm 63, and passes through the opening or space 57 between the housing legs 55, to protect the worm 63 from damage from objects which are dropped.

The brake mechanism 45 mounted on housing 43 and connected to chuck 15 acts to brake the rotational speed of chuck 15 and any paper roll that may be supported between the chucks 15, 16.

The chuck support assembly 47 of chuck 16 is mounted on housing 49 by a lateral adjustment mechanism 67 including a mounting plate 69 held in place by a threaded rod 71 and nut 73. The other end of threaded rod 71 is connected to a reduction gear box 75 operated by a handle 77 which is turned to rotate threaded rod 71 connected to a nut 78 mounted in chuck support assembly 47. Rotation of rod 71 causes nut 78 to move support assembly 47 laterally to line up chuck 16 with chuck 15. Assembly 47 is provided with a bottom plate 79 that is moved laterally in guide grooves 81, 82.

The legs 55 of each housing 43, 49 are provided with cylindrical openings 83 that are parallel to each other and to the worm 63 between them. The rails 51, 53 are slideably positioned in cylindrical openings 83, and the ends of each rail 51, 53 and each worm 63, and each guard 65 are supported in end supports 85, 87, with guards 65 being attached by screws 88.

A hydraulically operated lift table 89 is positioned between the chucks 15 and 16 and below the level of the chucks. The paper roll 13, which may be very heavy, is placed on the lift table 89, and the control mechanism of table 89 is operated to raise the table and lift the roll 13 into position between chucks 15, 16. Then chucks 15, 16 are moved toward each other in unison, by rotating the worms 63 to slide housings 43 and 49 along rails 51, 53, to engage the ends 17, 18 of the core 19 of the roll 13 and rotatably support the roll.

The worm 63 of housing 43 is driven by a motor 91, and the worm 63 of housing 49 is driven by a motor 93, with the motors being in synchronism with each other so that housings 43, 49 are moved in unison.

Guard 65 is a channel-shaped member having a back panel or web 95 connecting a pair of depending flanges 97, with web 95 protecting the worm 65 from any objects falling from above, and also providing protection against objects attacking worm 65 from the sides.

I claim:

1. A backstand for unwinding all or part of a roll of paper, comprising a pair of chucks facing each other and adapted to enter opposite ends of a core of a roll of paper, a housing for each of the chucks, chuck support means for rotatably supporting each of said chucks, housing support means slideably supporting each housing for movement toward and away from each other, each of said housings having a pair of legs with a space in between, power means for moving said housings toward and away from each other so that said chucks spread apart to receive a roll of paper and move toward each other to engage the ends of the core of the roll and rotatably support the roll, said power means including a rotatable worm mounted beneath each housing in the opening between the housing legs, a support plate connected between the legs of each housing, a worm nut mounted on top of each support plate and engaging its associated worm, and a guard mounted over each worm and passing through the opening between the housing legs to protect the worm from damage from objects which are dropped, such as rolls of paper;

brake means mounted on one of said housings and connected to its chuck for braking the rotational speed of said chuck and any paper roll it may be supporting, said guard being a channel-shaped member having a web connecting a pair of depending flanges with the web protecting the worm from any objects falling from above and the flanges providing protection to the sides;

each of said housing support means including a cylindrical opening in each leg of each housing, said cylindrical openings being parallel to each other and to the worm between them, a shaft positioned in each cylindrical opening, with the ends of each shaft and worm being supported by an end support;

the worm of one housing being driven by a motor and the worm of the other housing being driven by another motor with the motors being in synchronism with each other so that the housings are moved in unison; and lift table means positioned between the chucks and below the level of the chucks and between said worms for lifting the paper roll into position to be engaged and rotatably supported by said chucks.

2. A backstand for unwinding all or part of a roll of paper, comprising a pair of chucks facing each other and adapted to enter opposite ends of a core of a roll of paper, a housing for each of the chucks, chuck support means for rotatably supporting each of said chucks, housing support means slideably supporting each housing for movement toward and away from each other, each of said housings having a pair of legs with a space in between, power means for moving said housings toward and away from each other so that said chucks spread apart to receive a roll of paper and move toward each other to engage the ends of the core of the roll and rotatably support the roll, said power means including a rotatable worm mounted beneath each housing in the opening between the housing legs, a support plate connected between the legs of each housing, a worm nut mounted on top of each support plate and engaging its associated worm, and a guard mounted over each worm and passing through the opening between the housing legs to protect the worm from damage from objects which are dropped, such as rolls of paper, alignment means mounted on one of said housings and connected to its chuck for laterally aligning one chuck with the other, and said chuck support means rotatably supporting said chuck and mounted on its housing so as to be laterally movable by said alignment means, the chuck support means of one of said chucks being mounted on its housing by a lateral adjustment means including a mounting plate held in place by a threaded rod and nut, the other end of the threaded rod being connected to a reduction gear box operated by a handle which is turned to rotate said threaded rod connected to a nut adapted to move said chuck support means laterally to line up the chucks.

3. A backstand for unwinding all or part of a roll of paper, comprising a pair of chucks facing each other and adapted to enter opposite ends of a core of a roll of paper, a housing for each of the chucks, chuck support means for rotatably supporting each of said chucks, housing support means slideably supporting each housing for movement toward and away from each other, each of said housings having a pair of legs with a space in between, power means for moving said housings toward and away from each other so that said chucks spread apart to receive a roll of paper and move toward each other to engage the ends of the core of the roll and rotatably support the roll, said power means including a rotatable worm mounted beneath each housing in the opening between the housing legs, a support plate connected between the legs of each housing, a worm nut mounted on top of each support plate and engaging its associated worm, and a guard mounted over each worm and passing through the opening between the housing legs to protect the worm from damage from objects which are dropped, such as rolls of paper, brake means mounted on one of said housings and connected to its chuck for braking the rotational speed of said chuck and any paper roll it may be supporting, alignment means mounted on one of said housings and connected to its chuck for laterally aligning one chuck with the other, said chuck support means rotatably supporting said chuck and mounted on its housing so as to be laterally movable by said alignment means, each of said housing support means including a cylindrical opening in each leg of each housing, said cylindrical openings being parallel to each other and to the worm between them, a shaft positioned in each cylindrical opening, with the ends of each shaft and worm being supported by an end support, and lift table means positioned between the chucks and below the level of said chucks and between said worms for lifting the paper roll into position to be engaged and rotatably supported by said chucks, each of said chucks being welded together and including tapered fins connected at their base to a flange removably bolted to a flange of a rotatable chuck shaft, the chuck support means of one of said chucks being mounted on its housing by a lateral adjustment means including a mounting plate held in place by a threaded rod and nut, the other end of the threaded rod being connected to a reduction gear box operated by a handle which is turned to rotate said threaded rod connected to a nut adapted to move said chuck support means laterally to line up the chucks, the worm of one housing being driven by a motor and the worm of the other housing being driven by another motor with the motors being in synchronism with each other so that the housings are moved in unison, said guard being a channel-shaped member having a web connecting a pair of depending flanges with the web protecting the worm from any objects falling from above and the flanges providing protection to the sides.

* * * * *